US005527089A

United States Patent [19]

Charest

[11] Patent Number: 5,527,089

[45] Date of Patent: Jun. 18, 1996

[54] CONVERTIBLE CHAIR AND LOAD CARRIER DEVICE

[76] Inventor: Émilien Charest, 247, rue Cartier, Lachenaie, (Québec), Canada, J6W 5X7

[21] Appl. No.: 393,813

[22] Filed: Feb. 24, 1995

[51] Int. Cl.[6] ..... A47C 13/00

[52] U.S. Cl. ..... 297/129; 297/4; 297/183.1; 224/155

[58] Field of Search ..... 297/1–4, 256.14, 297/256.1, 250.1, 118, 129, 188.01, 188.04, 188.05, 183.1, 183.5; 224/155, 151, 153

[56] References Cited

U.S. PATENT DOCUMENTS

| | | | |
|---|---|---|---|
| 672,980 | 4/1901 | Hunter . | |
| 1,150,664 | 8/1915 | Cramer . | |
| 1,574,659 | 2/1926 | Johnston . | |
| 1,723,147 | 8/1929 | Fourethier . | |
| 1,921,622 | 8/1933 | Korth . | |
| 2,480,402 | 8/1949 | Elston | 224/25.1 |
| 2,498,428 | 2/1950 | Kruse | 311/21 |
| 2,555,073 | 5/1951 | Zdankoski | 43/54.5 |
| 2,836,334 | 5/1958 | Dans | 297/4 X |
| 2,967,649 | 1/1961 | Mack | 297/4 |
| 2,973,888 | 3/1961 | Beardsley | 224/9 |
| 3,127,077 | 3/1964 | Faro | 224/26 |
| 3,266,686 | 8/1966 | Griffith | 224/9 |
| 3,292,830 | 12/1966 | Mack | 224/9 |
| 3,662,932 | 5/1972 | Kerschner | 224/9 |
| 3,690,525 | 9/1972 | Koons | 224/9 |
| 3,822,422 | 7/1974 | Buntyn | 5/114 |
| 3,912,138 | 10/1975 | Pava | 224/10 |
| 3,938,718 | 2/1976 | Madison | 224/25 A |
| 3,957,183 | 5/1976 | Gadberry | 224/5 W |
| 4,286,739 | 9/1981 | Silcott et al. | 224/156 |
| 4,530,451 | 7/1985 | Hamilton | 224/155 |
| 4,762,256 | 8/1988 | Whitaker | 297/4 X |
| 4,836,938 | 6/1989 | Kobasic | 224/155 |
| 4,847,950 | 7/1989 | Coleman | 16/363 |
| 4,925,064 | 5/1990 | Comora | 297/4 X |
| 4,934,573 | 6/1990 | Jaeger | 224/210 |
| 4,938,400 | 7/1990 | Springston | 224/155 |
| 4,989,766 | 2/1991 | Lewallyn et al. | 224/155 |
| 5,031,811 | 7/1991 | Charest | 224/155 |
| 5,131,575 | 7/1992 | Charest | 224/155 |

FOREIGN PATENT DOCUMENTS

| | | |
|---|---|---|
| 802469 | 2/1951 | Germany . |
| 474581 | 9/1952 | Italy . |
| 51075 | 6/1932 | Norway . |
| 394594 | 6/1933 | United Kingdom . |
| 1085217 | 9/1967 | United Kingdom . |

*Primary Examiner*—Milton Nelson, Jr.

[57] ABSTRACT

The convertible chair and load carrier device comprises a dorsal member, a harness for attaching the dorsal member to the user's back, a load support member and a peg-and-groove system for removably mounting the load support member on the dorsal member in either a first position to form a load carrier device or a second position to form a chair. In the first position, the load support member can be turned upside down to form a chair carrier device usable to transport a child. The peg-and-groove system comprises, on each side, first and second pegs formed on the load support member and first, second and third grooves formed on the dorsal member. The first and second grooves each have a bottom face provided with a generally rectangular protuberance situated centrally of the groove while the first peg is formed of two spaced apart peg elements generally half-moon shaped in cross section. To removably install the load support member on the dorsal member, the first peg is inserted in the first or second groove by sliding the rectangular protuberance in the passage between the two peg elements. The load support member is then pivoted about the first peg until the second peg is inserted in the third groove.

10 Claims, 4 Drawing Sheets

21
64
69
65
63
68
45
43
12
12
70
57
66
12
67

CONVERTIBLE CHAIR AND LOAD CARRIER DEVICE

BACKGROUND OF THE INVENTION

1. Field of the Invention

The present invention relates to a multipurpose device that can be converted either (a) to a chair, or (b) to a load carrier device attachable to the user's back. In a preferred embodiment, the device can also be converted to a chair carrier device usable to transport a child.

2. Brief Description of the Prior Art

U.S. Pat. No. 2,480,402 granted to W. H. ELSTON on Aug. 30, 1949 proposes a convertible chair and load carrier device of the same type.

The device of ELSTON can be converted to a chair attachable to a boat's transverse seat to allow the user to sit in the boat both safely and comfortably.

The seat and the back of ELSTON's chair can be arranged coplanar with each other to convert this chair to an outboard motor carrier device. A harness is then secured to this carrier devicé to enable attachment thereof on the user's back. A motor support is also installed on the carrier device to support the outboard motor while it is transported.

A first drawback of ELSTON's convertible chair and load carrier device is its lack of versatility. Indeed, it is designed to carry only an outboard motor.

Another drawback of ELSTON's convertible chair and load carrier device is its complexity, which increases the manufacturing costs. It comprises numerous parts each having a different, specific function. For example, separate members are required to form the seat of the chair and the outboard motor support.

U.S. Pat. No. 5,031,811 (CHAREST) issued on Jul. 16, 1991 describes a convertible chair and load carrier device comprising a dorsal member, a harness for attaching the dorsal member on the user's back, a load support member, and a hinge system for pivotally mounting a proximate end of the load support member to a lower end of the dorsal member whereby the load support member can be pivoted about the dorsal member between first and second positions. The hinge system is also designed for locking the load support member on the dorsal member in either one of the first and second positions. In the first position the load support member extends rearwardly of the dorsal member and is generally perpendicular to this dorsal member to form an L-shaped load carrier device. In the second position the load support member extends forwardly of the dorsal member to define a chair having a seat formed by the load support member and a back formed by the dorsal member.

Although efficient, the hinge system of CHAREST requires various parts and complex plastic molding operations, which increase the manufacturing costs.

OBJECTS OF THE INVENTION

An object of the present invention is to provide a convertible chair and load carrier device that can be used to carry loads of different types and that can be manufactured at low cost using conventional plastic molding techniques.

Another object of the present invention is to simplify connection of the load support member to the dorsal member of a convertible chair and load carrier device.

SUMMARY OF THE INVENTION

More particularly, the subject invention relates to a convertible chair and load carrier device, comprising:

left and right sides;

a dorsal member defining a front face and having on each left and right side a lower projection defining an inner face;

harness means for attaching the dorsal member on the back of a user with the front face of the dorsal member resting on the user's back;

a load support member having a side edge face on each left and right side; and a peg-and-groove system for removably mounting the load support member on the dorsal member in either a first position to form a load carrier device or a second position to form a chair.

The peg-and-groove system comprises on each left and right side a first set of peg means and a second set of groove means, the peg means and the groove means being formed on the inner face of the lower projection and the side edge face of the load support member. For removably mounting the load support member on the dorsal member in each of the first and second positions, a first peg means of the first set is inserted in a first groove means of the second set and the load support member is then pivoted about the first peg means for inserting a second peg means of the first set in a second groove means of the second set, the first peg means being formed with a passage means and the first groove means having a bottom face formed with a protuberance means sliding in the passage means upon insertion of the first peg means in the first groove means.

Advantageously, in the first position, the load support member extends rearwardly of the dorsal member, is generally perpendicular to the dorsal member to form an L-shaped load carrier device, and has a top face on which a load to be carried by the user can be disposed. In the second position, the load support member extends forwardly of the dorsal member to form a chair having a seat constituted by the load support member and a back constituted by the dorsal member.

According to a preferred embodiment, the load support member has first and second opposite faces and, in the first position, the load support member has a top face constituted by either one of these first and second opposite faces.

According to other preferred embodiments of the subject invention:

the load support member comprises a proximate edge face and a distal edge face;

the lower projection comprises a bottom edge face, a front edge face and a rear edge face;

the second peg means is formed on the side edge face of the load support member close to the proximate edge face of the load support member;

the first peg means is formed on the side edge face of the load support member between the second peg means and the distal edge face of the load support member;

the second set of groove means comprises a front groove extending generally rearwardly from the front edge face, a rear groove extending generally forwardly from the rear edge face, and a central groove extending generally upwardly from the bottom edge face of the lower projection.

the first and second peg means are slightly tapered and generally circular in cross section;

the front groove extending generally rearwardly from the front edge face terminates into a first generally semi-circular cavity;

the rear groove extending generally forwardly from the rear edge face terminates into a second generally semi-circular cavity;

the central groove extending generally upwardly from the bottom edge face terminates into a third generally semicircular cavity;

the front groove has a bottom face provided with a first generally rectangular protuberance situated centrally of the groove between the front edge face and the first generally semicircular cavity;

the rear groove has a bottom face provided with a second generally rectangular protuberance situated centrally of the rear groove between the rear edge face and the second generally semicircular cavity;

the first peg means is formed of two peg elements generally half-moon shaped in cross section and spaced apart from each other to form the passage means which extends generally perpendicular to a plane in which the load support member is lying; and the lower projection is formed by a generally trapezoidal member fixed to the dorsal member and defining the bottom edge face, the front edge face and the rear edge face.

Accordingly, for removably mounting the load support member on the dorsal member in the first position, (a) the first peg means is inserted in the rear groove by sliding the second generally rectangular protuberance in the passage means between the two peg elements until the first peg means reaches the second generally semicircular cavity, and (b) the load support member is pivoted about the first peg means rotating in the second generally semicircular cavity until the second peg means is inserted in the central groove and reaches the third generally semicircular cavity. In the same manner, for removably mounting the load support member on the dorsal member in the second position, (a) the first peg means is inserted in the front groove by sliding the first generally rectangular protuberance in the passage means between the two peg elements until the first peg means reaches the first generally semicircular cavity, and (b) the load support member is pivoted about the first peg means rotating in the first generally semicircular cavity until the second peg means is inserted in the central groove and reaches the third generally semicircular cavity.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
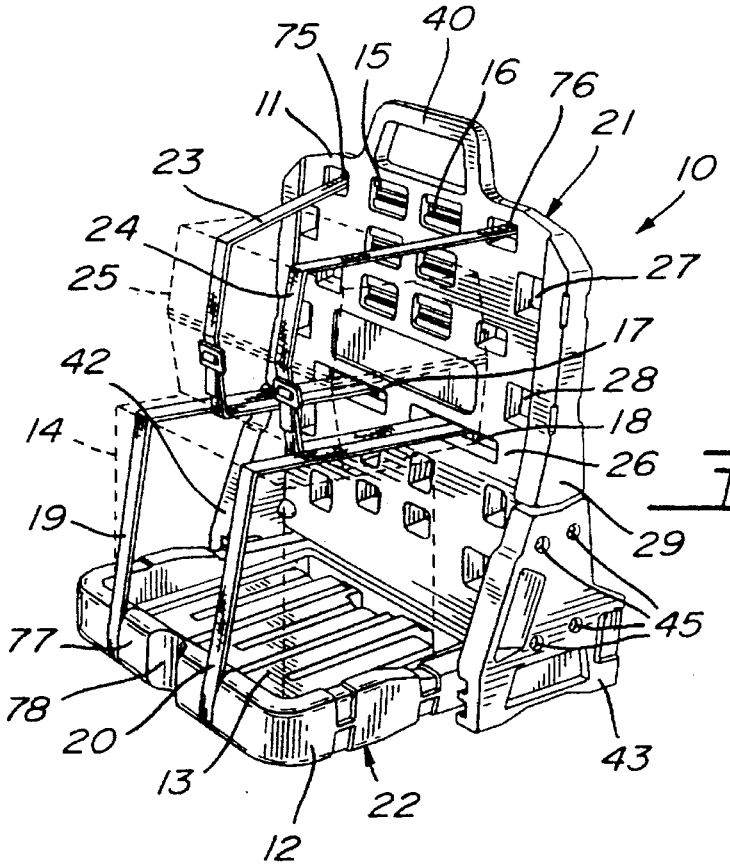
FIG. 1 is a perspective view of a convertible chair and load carrier device according to the invention, converted into a load carrier device.
Figure 2:
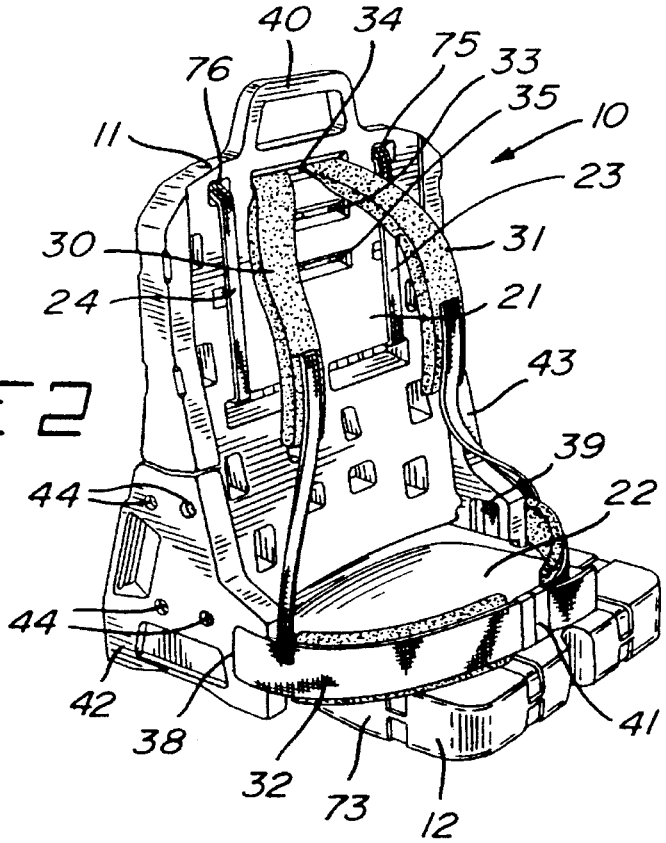
FIG. 2 is a perspective view of the convertible chair and load carrier device of FIG. 1, converted into a chair.

As illustrated in FIGS. 1 and 2, the convertible chair and load carrier device, generally identified by the reference numeral 10, comprises a dorsal member 11 and a load support member 12.

In FIG. 1, the device 10 is converted into a load carrier device.

As shown in FIG. 1, the load support member 12 is then in a first, generally horizontal position. In this first position, the load support member 12 extends rearwardly of the dorsal member 11, and is generally perpendicular to the dorsal member 11 to form an L-shaped load carrier device. Then, the load support member 12 has a top face 13 on which a load to be carried by the user can be placed. As illustrated in FIG. 1, the top face 13 is hollowed out to receive a load such as a marine battery 14 (shown in dashed lines) for powering an electric outboard motor (not shown).

The dorsal member 11 is generally vertical and is formed with a plurality of horizontal slots such as 17 and 18. In the example of FIG. 1, a pair of straps 19 and 20 pass through the slots 17 and 18, respectively, and then extend downwardly (not shown) onto the front face 21 of the dorsal member 11 and rearwardly (not shown) onto the bottom face 22 of the load support member 12 to thereby encircle the battery 14 and hold it onto the top face 13 of the load support member 12.

As a further example, another pair of straps 23 and 24 are used for attaching a tackle box 25 (shown in dashed lines in FIG. 1) on the rear face 26 of the dorsal member 11. The straps 23 and 24 pass through upper horizontal slots 75 and 76, respectively, extend downwardly onto the front face 21 of the dorsal member 11 (see FIG. 2), pass through the horizontal slots 17 and 18, respectively, to finally encircle the tackle box 25 to thereby apply and retain this tackle box 25 to the rear face 26 of the dorsal member 11.

Several other vertical and/or horizontal slots are formed on the dorsal member 11 to attach to that dorsal member 11 a great variety of articles to be transported. For example, short straps (not shown) may be passed through vertical slots such as 27 and 28 to encircle and attach to the side face 29 of the dorsal member 11 a fishing rod (not shown). In the same manner, the edge 77 of the load support member 12 may be formed with a central, vertical and semicircular slot 78 to fit an electric or gas outboard motor (not shown) on the load support member 12.

As can be appreciated from FIG. 1 of the appended drawings, the convertible chair and load carrier device 10 according to the present invention is very versatile and can be used to carry a great variety of articles and/or loads.

Figure 3:
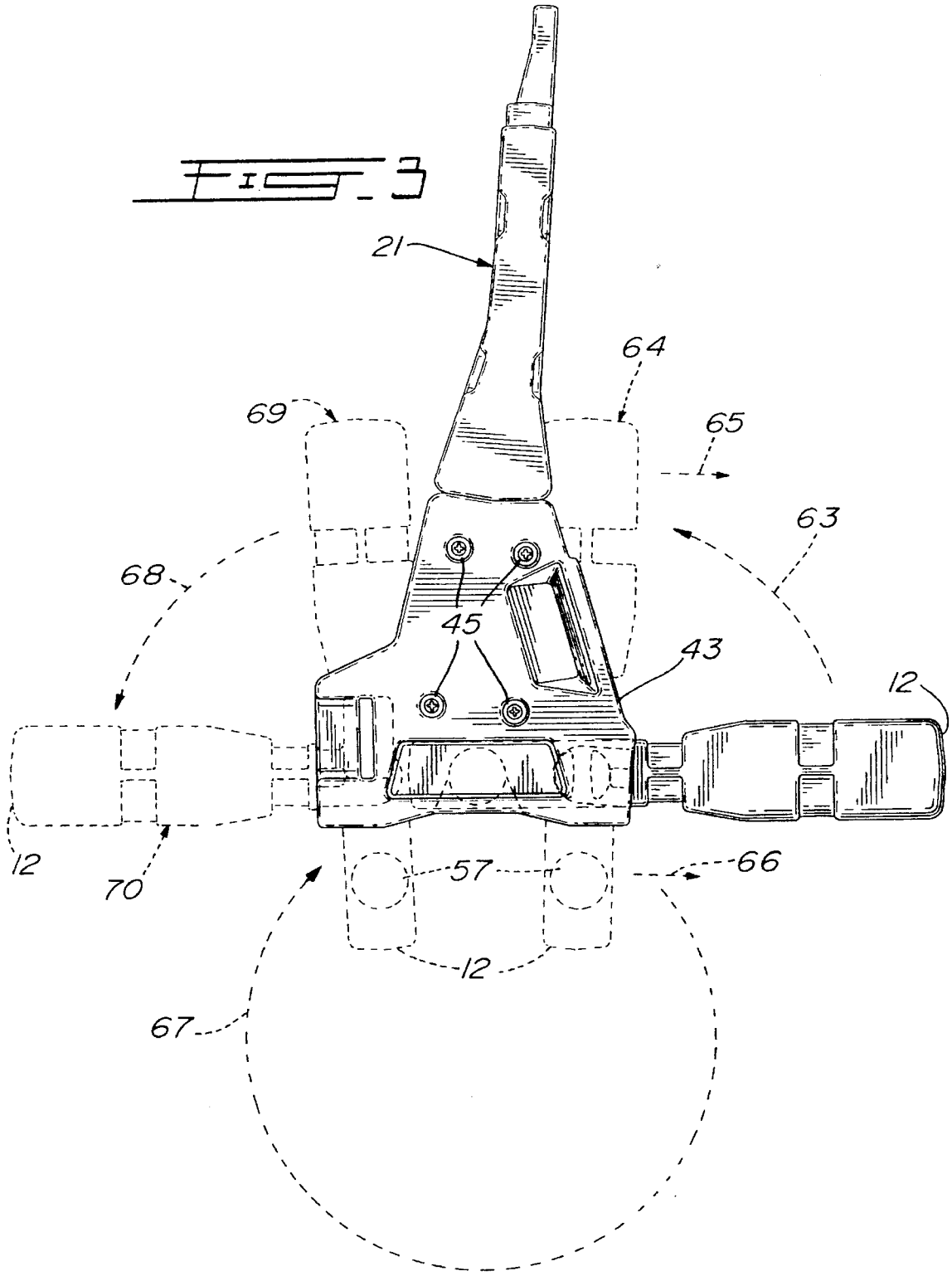
FIG. 3 is a side elevational view of the convertible chair and load carrier device of FIGS. 1 and 2, comprising a dorsal member and a load support member pivotally mounted onto this dorsal member.

As it is apparent from FIGS. 2 and 3, the front face 21 of the dorsal member 11 is arcuate to present a slight concavity adapting the contour of the user's back. In order to attach the dorsal member 11 of the convertible chair and load carrier device 10 on the user's back with the front face 21 of the dorsal member 11 resting on the user's back, a harness including a pair of shoulder straps 30 and 31 as well as a hip belt 32 is provided.

The shoulder straps 30 and 31 are preferably padded with soft material for the user's comfort. For a better support of the convertible chair and load carrier device 10 by the shoulders of the user, flat, substantially rigid, elongated and arcuate members (not shown) may be inserted into compartments respectively formed in the shoulder straps 30 and 31. As illustrated in FIG. 2, the shoulder straps 30 and 31 have their respective upper ends secured to an upper horizontal slot 34 of the dorsal member 11. However, the upper ends of the shoulder straps 30 and 31 may also be secured to either one of the horizontal slots 33 and 35, situated under slot 34. Slots 33–35 enable the user to adjust the height of the upper ends of the shoulder straps 30 and 31 so as to fit the device 10 on his body. Also, the shoulder straps 30 and 31 have their respective lower ends secured to the respective sides of the hip belt 32 through respective buckles (not shown).

Of course, the hip belt 32 may also be padded with soft material for the user's comfort. As shown in FIG. 2, the two ends of the hip belt 32 are secured to respective side slots 38 and 39 of the dorsal member 11.

The harness of the convertible chair and load carrier device 10 is otherwise conventional and accordingly it will not be further described. In particular, the fixation of the shoulder straps 30 and 31 and of the hip belt 32 to the dorsal member 11 can be carried out in a plurality of different ways known to those of ordinary skill in the art. The present invention is obviously not limited to the type of harness and fixation.

To help in handling the convertible chair and load carrier device 10 of the present invention, the dorsal member 11 is formed with an upper handle 40.

When the convertible chair and load carrier device 10 is converted into a chair as illustrated in FIG. 2, the load support member 12 is in a second position approximately 180° apart from its first position of FIG. 1 (in which the device 10 is converted into a load carrier). In the second position of FIG. 2, the load support member 12 extends forwardly of the dorsal member 11 to form a chair having a seat constituted by the load support member 12 and a back constituted by the dorsal member 11. More specifically, the load support member 12 has a top face 22 shaped to form a seat, and the front face 21 of the dorsal member 11 is shaped to adapt the contour of the user's back. Of course, when the device 10 is converted to a chair, the buckle 41 of the belt 32 can be detached and the harness moved away to clear the chair.

The peg-and-groove system for removably connecting and mounting the load support member 12 on the dorsal member 11 in either one of the first and second positions of FIGS. 1 and 2 will now be described in particular with reference to FIGS. 3, 4 and 5 of the appended drawings.

Lower and generally trapezoidal members 42 and 43 (FIGS. 1–5) are connected to the dorsal member 11 on the left and right sides of the convertible chair and load carrier device 10, respectively. More specifically, trapezoidal member 42 is fastened to the left side of the dorsal member 11 by means of four screws 44 (FIG. 2). In the same manner, trapezoidal member 43 is fastened to the right side of the dorsal member 11 by means of four other screws 45 (FIGS. 1 and 3).

Figure 4:
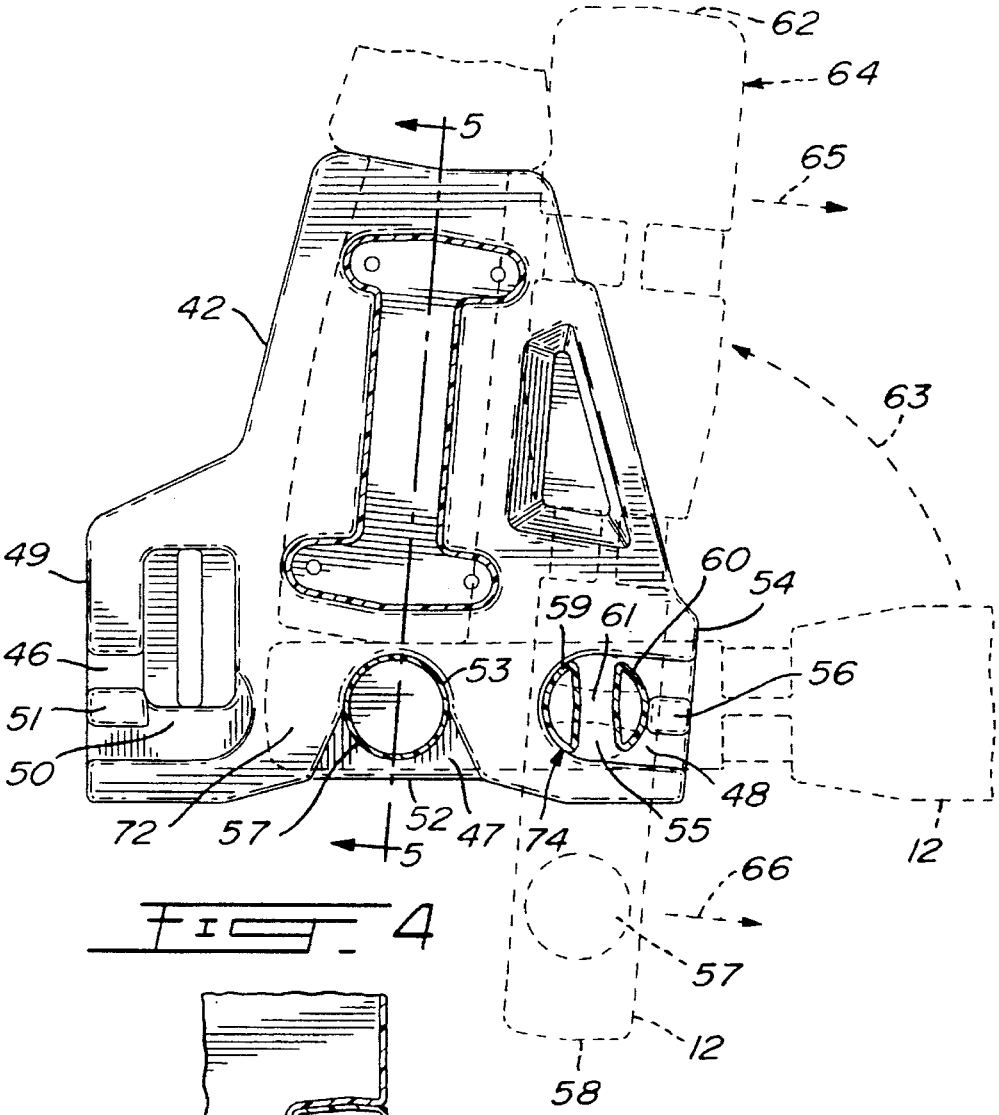
FIG. 4 is a side elevational view, partially cross sectional, of a peg-and-groove system for removably connecting and mounting the load support member to the dorsal member of the convertible chair and load carrier device of FIGS. 1, 2 and 3.
Figure 5:
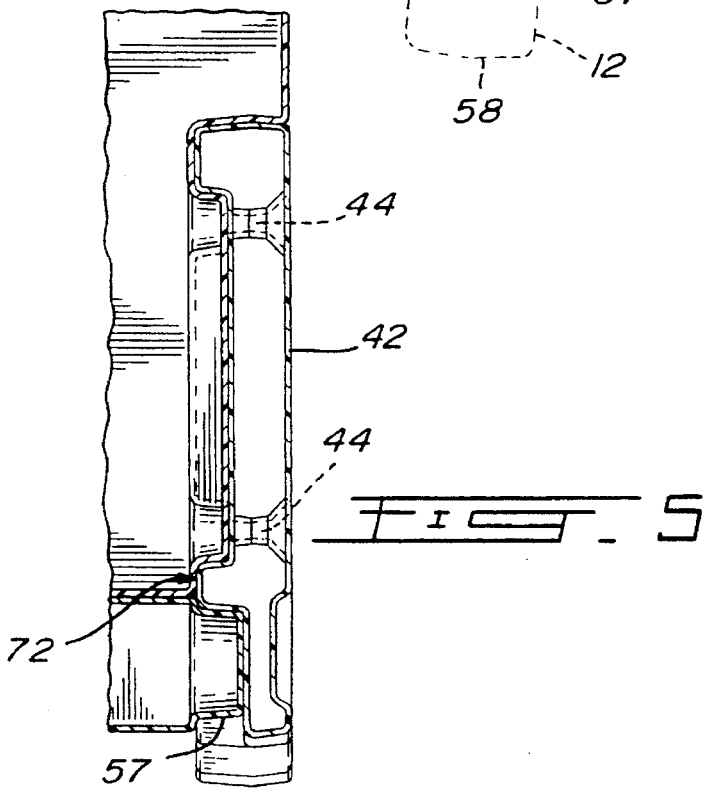
FIG. 5 is a cross sectional view, taken along line 5—5 of FIG. 4, of the peg-and-groove system for connecting the load support member to the dorsal member.

Referring now to FIG. 4, the generally trapezoidal members 42 and 43 form on each left and right side of the convertible chair and load carrier device 10 a lower projection of the dorsal member 11 defining an inner face such as 72 (see FIGS. 4 and 5 for trapezoidal member 42). On each left and right side of the convertible chair and load carrier device 10, the peg-and-groove system comprises a front groove 46, a central groove 47 and a rear groove 48 formed on the inner face such as 72 of the lower projection of the dorsal member 11.

The front groove 46 extends generally rearwardly from the front edge face 49 of the lower projection to terminate into a generally semicircular cavity 50. The entrance of the semicircular cavity 50 is obstructed by a generally rectangular protuberance 51 formed on the bottom face of the front groove 46 and situated generally centrally of that groove 46 between the front edge face 49 and the generally semicircular cavity 50.

The central groove 47 extends generally upwardly from the bottom edge face 52 of the lower projection to terminate into a generally semicircular cavity 53. The central groove 47 widens out from the generally semicircular cavity 53 toward the bottom edge face 52 of the lower projection.

The rear groove 48 extends generally forwardly from the rear edge face 54 of the lower projection to terminate into a generally semicircular cavity 55. The entrance of the semicircular cavity 55 is obstructed by a generally rectangular protuberance 56 formed on the bottom face of the rear groove 48 and situated generally centrally of that groove 55 between the rear edge face 54 and the generally semicircular cavity 55.

On each of the left and right sides of the convertible chair and load carrier device 10, the load support member 12 defines a side edge face such as 73 (FIG. 2) of the load support member 12 on which are formed:

- a first, slightly tapering peg 57 generally circular in cross section and closer to the proximate edge face 58 of the load support member 12; and
- a second, slightly tapering peg 74 generally circular in cross section and formed of two peg elements 59 and 60 both generally half-moon shaped in cross section and spaced apart to define between them a passage 61 extending generally perpendicular to the plane in which the load support member 12 is lying.

The peg 74, formed of the two peg elements 59 and 60 is situated between the peg 57 and the distal edge face 62 of the load support member.

As can be appreciated by those of ordinary skill in the art, the two peg elements 59 and 60 define the contour of a single slightly tapering peg (74) generally circular in cross section and capable of rotating in the semicircular cavities 50 and 55.

Finally, the width of the passage 61 between the peg elements 59 and 60 is slightly larger than the width of the protuberances 51 and 56 to allow the latter protuberances to slide in this passage 61.

Operation of the convertible chair and load carrier device 10 according to the invention will now be described with reference to FIGS. 1–5 of the appended drawings.

In order to convert the device 10 from a load carrier device (FIG. 1) to a chair (FIG. 2), the following steps are carried out, obviously on the two sides of the convertible chair and load carrier device 10:

(a) The load support member 12 is first pivoted in the direction of the arrow 63 of FIGS. 3 and 4 from its generally horizontal position of FIG. 1 (in which face 13 is the top face) to a generally vertical position (see position 64 shown in dashed lines in FIGS. 3 and 4). The two half-moon shaped peg elements 59 and 60 then rotate in the semicircular cavity 55 while the slightly tapering peg 57 leaves the generally semicircular cavity 53.

(b) The load support member 12, in the generally vertical position 64, is translated in the direction of the arrows 65 and 66 (FIGS. 3 and 4) until the two half-moon shaped peg elements 59 and 60 leave the rear groove 48. During this operation, the generally rectangular protuberance 56 slides in the passage 61 between the two half-moon shaped peg elements 59 and 60.

(c) The load support member 12 is then pivoted (see arrow 67 of FIG. 3) by approximately 180° until it reaches a generally vertical position.

(d) The two half-moon shaped peg elements 59 and 60 are then inserted in the front groove 46 until they reach the semicircular cavity 50. During this operation, the generally rectangular protuberance 51 of the front groove 46 slides in the passage 61 between the two half-moon shaped peg elements 59 and 60. The load support member 12 is then in the generally vertical position shown at 69 in FIG. 3.

(e) Finally, the load support member 12 is pivoted (see arrow 68 in FIG. 3) from the generally vertical position 69 to the generally horizontal position 70 of FIG. 3 until the slightly tapering peg 57 is fitted in the semicircular cavity 53 of the central groove 47. Face 22 is then the top face of the load support member 12. During this operation, the peg 74 rotates in the generally semicircular cavity 50.

The load support member 12 is then removably mounted on the dorsal member in the second position to convert the device 10 to a chair (FIG. 2).

To convert the device 10 from a chair (FIG. 2) to a load carrier (FIG. 1), the inverse steps are carried out, obviously on the two sides of the convertible chair and load carrier device 10:

(a) The load support member 12 is first pivoted from its generally horizontal position 70 of FIG. 3 (corresponding to the position of FIG. 2 in which face 22 is the top face) to the generally vertical position 69 shown in dashed lines in FIG. 3. The two half-moon shaped peg elements 59 and 60 then rotate in the semicircular cavity 50 (FIG. 4) while the slightly tapering peg 57 leaves the semicircular cavity 53 of the central groove 47.

(b) The load support member 12, in the generally vertical position 69 of FIG. 3, is pulled and translated forwardly until the two half-moon shaped peg elements 59 and 60 leave the front groove 46. During this operation, the generally rectangular protuberance 51 slides in the passage 61 between the two half-moon shaped peg elements 59 and 60.

(c) The load support member 12 is then pivoted by approximately 180° in the direction opposite to arrow 67 until it reaches a generally vertical position.

(d) The two half-moon shaped peg elements 59 and 60 are then inserted into the rear groove 48 until they reach the semicircular cavity 55. During this operation, the generally rectangular protuberance 56 of the rear groove 48 slides in the passage 61 between the two half-moon shaped peg elements 59 and 60. The load support member is then in the generally vertical position shown at 64 in FIGS. 3 and 4.

(e) Finally, the load support member 12 is pivoted in the direction opposite to arrow 63 from the generally vertical position 64 to the generally horizontal position shown in full lines in FIGS. 1 and 3. The slightly tapering peg 57 is then fitted in the semicircular cavity 53 of the central groove 47. Face 13 is then the top face of the load support member 12. During this operation, peg 74 rotates in the semicircular cavity 55.

The load support member 12 is then removably mounted on the dorsal member 11 in the first position to convert the device 10 to a load carrier device (FIG. 1).

The load support member 12 of the load carrier device of FIG. 1 can also be turned upside down to convert the device 10 to a chair carrier device (FIG. 6) constituting a second type of load carrier device.

In order to convert the device 10 from a load carrier device (FIG. 1) to a chair carrier device (FIG. 6), the following steps are carried out, obviously on the two sides of the convertible chair and load carrier device 10:

(a) The load support member 12 is first pivoted in the direction of the arrow 63 of FIGS. 3 and 4 from its generally horizontal position of FIG. 1 (in which face 13 is the top face) to a generally vertical position (see position 64 shown in dashed lines in FIGS. 3 and 4). The two half-moon shaped peg elements 59 and 60 then rotate in the semicircular cavity 55 while the slightly tapering peg 57 leaves the generally semicircular cavity 53.

(b) The load support member 12, in the generally vertical position 64, is translated in the direction of the arrows 65 and 66 (FIGS. 3 and 4) until the two half-moon shaped peg elements 59 and 60 leave the rear groove 48. During this operation, the generally rectangular protuberance 56 slides in the passage 61 between the two half-moon shaped peg elements 59 and 60.

(c) The load support member 12 is then pivoted about a generally vertical axis (not shown) by approximately 180°.

(d) The two half-moon shaped peg elements 59 and 60 are then inserted into the rear groove 48 until they reach the semicircular cavity 55. During this operation, the generally rectangular protuberance 56 of the rear groove 48 slides in the passage 61 between the two half-moon shaped peg elements 59 and 60. The load support member 12 is then in the generally vertical position shown at 64 in FIGS. 3 and 4.

(e) Finally, the load support member 12 is pivoted in the direction opposite to arrow 63 from the generally vertical position 64 to the generally horizontal position shown in full lines in FIGS. 3 and 4. The slightly tapering peg 57 is then fitted in the semicircular cavity 53 of the central groove 47. Face 22 is then the top face of the load support member 12. During this operation, peg 74 rotates in the semicircular cavity 55.

Figure 6:
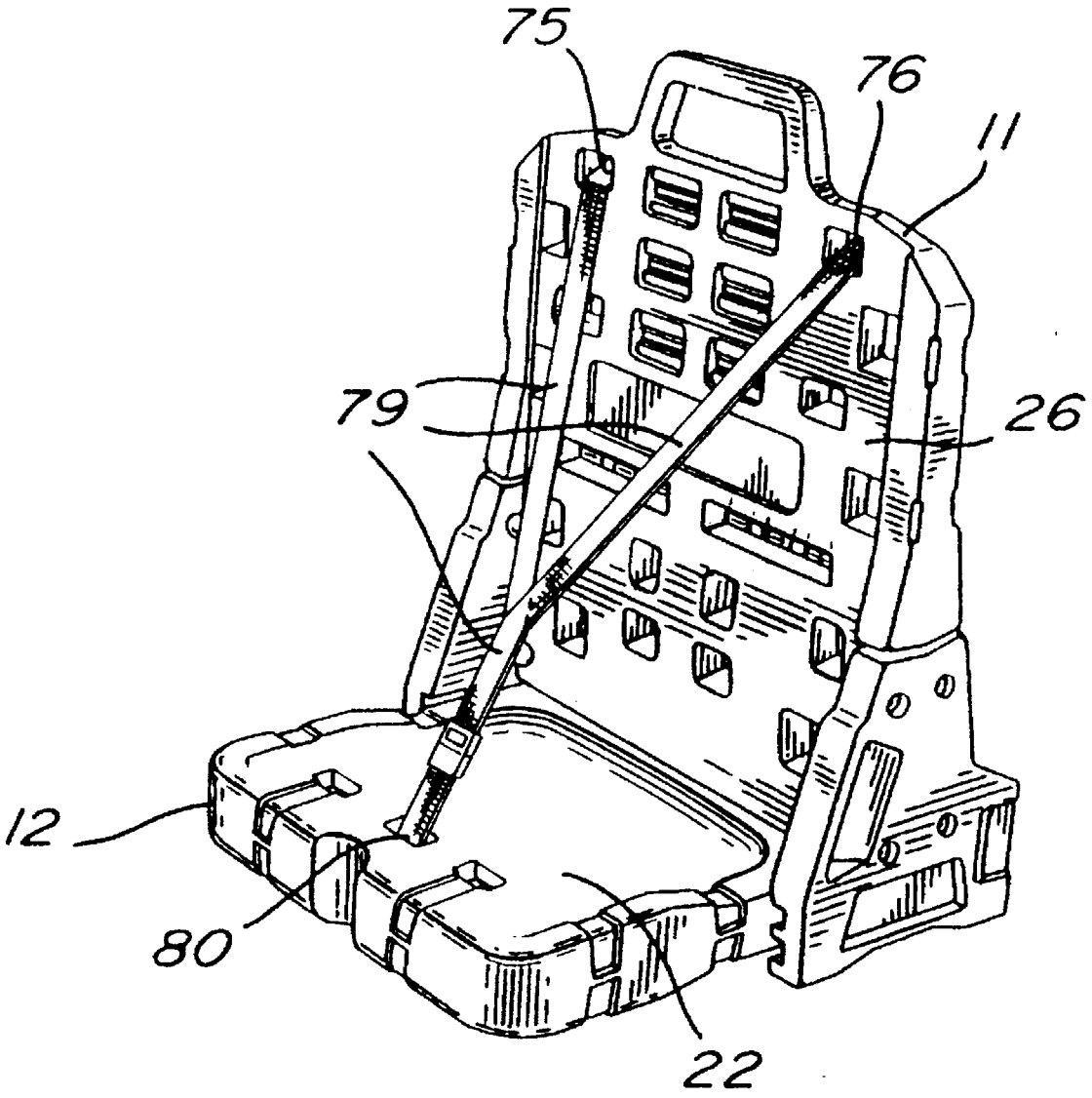
FIG. 6 is a perspective view of the convertible chair and load carrier device of FIGS. 1–5, converted into a chair carrier device.

The load support member 12 is then removably mounted on the dorsal member 11 in the position of FIG. 6 to convert the device 10 to a chair carrier device (FIG. 6). The rear face 26 of the dorsal member 11 then forms the back of the chair carrier device and the face 22 of the load support member 12 the seat of that chair carrier device. A child (not shown) can then be seated on the chair carrier device to allow the user person to transport this child. A harness 79 can then be secured to slots 75 and 76 of the dorsal member 11 and to a slot 80 of the load support member 12 to retain the child on the chair carrier device of FIG. 6.

To convert the device 10 from a chair (FIG. 2) to a chair carrier device (FIG. 6), the following steps are carried out, obviously on the two sides of the convertible chair and load carrier device 10:

(a) The load support member 12 is first pivoted from its generally horizontal position 70 of FIG. 3 (corresponding to the position of FIG. 2 in which face 22 is the top face) to the generally vertical position 69 shown in dashed lines in FIG. 3. The two half-moon shaped peg elements 59 and 60 then rotate in the semicircular cavity 50 (FIG. 4) while the slightly tapering peg 57 leaves the semicircular cavity 53 of the central groove 47.

(b) The load support member 12, in the generally vertical position 69 of FIG. 3, is pulled and translated forwardly until the two half-moon shaped peg elements 59 and 60 leave the front groove 46. During this operation, the generally rectangular protuberance 51 slides in the passage 61 between the two half-moon shaped peg elements 59 and 60.

(c) The load support member 12 is pivoted about a generally vertical axis (not shown) by approximately 180°, and the peg elements 59 and 60 are then placed in front of the rear groove 48.

(d) The two half-moon shaped peg elements 59 and 60 are then inserted into the rear groove 48 until they reach the semicircular cavity 55. During this operation, the generally rectangular protuberance 56 of the rear groove 48 slides in the passage 61 between the two half-moon shaped peg elements 59 and 60. The load support member 12 is then in the generally vertical position shown at 64 in FIGS. 3 and 4.

(e) Finally, the load support member 12 is pivoted in the direction opposite to arrow 63 from the generally vertical position 64 to the generally horizontal position shown in full lines in FIGS. 3 and 4. The slightly tapering peg 57 is then fitted in the semicircular cavity 53 of the central groove 47. Face 22 is then the top face of the load support member 12. During this operation, peg 74 rotates in the semicircular cavity 55.

The load support member 12 is then removably mounted on the dorsal member 11 in the position of FIG. 6 to convert the device 10 to a chair carrier device (FIG. 6).

As can be seen from the foregoing description, the passage 61 between the two peg elements 59 and 60 has a predetermined orientation, perpendicular to the plane in which the load support member 12 is lying, to enable sliding of the protuberances 51 and 56 in the passage 61 only when the load support member 12 is situated in a predetermined angular position about the dorsal member 11.

It is apparent from the cross sections of FIGS. 4 and 5 that both the members 11 and 12 are hollow and can advantageously be made of plastic material through an adequate, conventional molding process. Accordingly, the device 10 is capable of floating when dropped in water so that it can be easily recovered. It can even be capable of floating when loaded as long as the load is not too heavy.

Finally, it should be pointed out that the dorsal and load support members 11 and 12 are advantageously dimensioned to require a small pressure for sliding the protuberances 51 and 56 in the passage 61 between the peg elements 59 and 60, and for inserting the peg 57 in the semicircular cavity 53 to thereby clip the load support member 12 on the dorsal member 11.

Although the present invention has been described hereinabove with reference to a preferred embodiment thereof, this embodiment can be modified at will, within the scope of the appended claims, without departing from the spirit and nature of the subject invention.

What is claimed is:

1. A convertible chair and load carrier device, comprising:

left and right sides;

a dorsal member defining a front face and having on each of said left and right sides a lower projection defining an inner face;

harness means for attaching the dorsal member on the back of a user with the front face of the dorsal member resting on the user's back;

a load support member having a side edge face on each of said left and right sides; and a peg-and-groove system for removably mounting the load support member on the dorsal member in a first position to form a load carrier device or a second position to form a chair, the peg-and-groove system comprising on each of said left and right sides a set of peg means and a set of groove means, said peg means and said groove means being formed on the inner face of the lower projection and the side edge face of the load support member, wherein, for removably mounting the load support member on the dorsal member in each of the first and second positions, a first peg means of said set of peg means is inserted in a first groove means of said set of groove means and the load support member is then pivoted about said first peg means for inserting a second peg means of said set of peg means in a second groove means of said set of groove means, said first peg means being formed with a passage means and said first groove means having a bottom face formed with a protuberance means sliding in said passage means upon insertion of said first peg means in said first groove means.

2. A convertible chair and load carrier device as recited in claim 1, wherein the load support member has first and second opposite faces, and wherein, in said first position, the load support member has a top face constituted by either one of said first and second opposite faces.

3. A convertible chair and load carrier device as recited in claim 1, wherein said passage means of said first peg means has a predetermined orientation to enable sliding of said protuberance means in said passage means only when the load support member is situated in a first predetermined angular position about the dorsal member.

4. A convertible chair and load carrier device as recited in claim 1, wherein said first peg means comprises two peg elements spaced apart from each other to define said passage means.

5. A convertible chair and load carrier device as recited in claim 1, in which:

the load support member comprises a proximate end edge face and a distal end edge face;

the lower projection comprises a bottom edge face, a front edge face and a rear edge face;

said second peg means is formed on the side edge face of the load support member close to the proximate end edge face of the load support member;

said first peg means is formed on the side edge face of the load support member between said second peg means and the distal end edge face of the load support member; and said set of groove means is formed on the inner face of the lower projection and comprises a front groove extending generally rearwardly from the front edge face, a rear groove extending generally forwardly from the rear edge face, and a central groove extending generally upwardly from the bottom edge face of the lower projection.

6. A convertible chair and load carrier device as recited in claim 5, wherein:

said first and second peg means are slightly tapered and generally circular in cross section;

the front groove extending generally rearwardly from the front edge face terminates into a first generally semicircular cavity;

the rear groove extending generally forwardly from the rear edge face terminates into a second generally semicircular cavity; and the central groove extending generally upwardly from the bottom edge face terminates into a third generally semicircular cavity.

7. A convertible chair and load carrier device as recited in claim 6, wherein:

said front groove has a bottom face provided with a first generally rectangular protuberance forming said protuberance means and situated generally centrally of the groove between the front edge face and the first generally semicircular cavity, and said rear groove has a bottom face provided with a second generally rectangular protuberance forming said protuberance means and situated generally centrally of the rear groove between the rear edge face and the second generally semicircular cavity; and said first peg means is formed of two peg elements generally half-moon shaped in cross section and spaced apart from each other to form said passage means which extends generally perpendicular to a plane in which the load support member is lying;

whereby, for removably mounting the load support member on the dorsal member in the first position, (a) said first peg means is inserted in the rear groove by sliding the second generally rectangular protuberance in said passage means between the two peg elements until said first peg means reaches the second generally semicircular cavity, (b) the load support member is pivoted about the first peg means rotating in the second generally semicircular cavity until the second peg means is inserted in the central groove and reaches the third generally semicircular cavity; and whereby, for removably mounting the load support member on the dorsal member in the second position, (a) said first peg means is inserted in the front groove by sliding the first generally rectangular protuberance in said passage means between the two peg elements until said first peg means reaches the first generally semicircular cavity, (b) the load support member is pivoted about said first peg means rotating in the first generally semicircular cavity until said second peg means is inserted in the central groove and reaches the third generally semicircular cavity.

8. A convertible chair and load carrier device as recited in claim 5, wherein the lower projection is formed by a generally trapezoidal member fixed to the dorsal member and defining the bottom edge face, the front edge face and the rear edge face.

9. A convertible chair and load carrier device, comprising:

left and right sides;

a dorsal member defining a front face and having on each of said left and right sides a lower projection defining an inner face;

harness means for attaching the dorsal member on the back of a user with the front face of the dorsal member resting on the user's back;

a load support member having a side edge face on each of said left and right sides; and a peg-and-groove system for removably mounting the load support member on the dorsal member in a first position to form an L-shaped load carrier device or a second position to form a chair, wherein (a) in the first position the load support member extends rearwardly of the dorsal member, is generally perpendicular to the dorsal member to form said L-shaped load carrier device, and has a top face on which a load to be carried by the user can be disposed, and (b) in the second position the load support member extends forwardly of the dorsal member to form said chair having a seat constituted by the load support member and a back constituted by the dorsal member;

wherein the peg-and-groove system comprises on each of said left and right sides a set of peg means and a set of groove means, said peg means and said groove means being formed on the inner face of the lower projection and the side edge face of the load support member, and wherein, for removably mounting the load support member on the dorsal member in each of the first and second positions, a first peg means of said set of peg means is inserted in a first groove means of said set of groove means and the load support member is then pivoted about said first peg means for inserting a second peg means of said set of peg means in a second groove means of said set of groove means, said first peg means being formed with a passage means and said first groove means having a bottom face formed with a protuberance means sliding in said passage means upon insertion of said first peg means in said first groove means.

10. A convertible chair and load carrier device as recited in claim 9, wherein the load support member has first and second opposite faces, and wherein, in said first position, the load support member has a top face constituted by either one of said first and second opposite faces.

* * * * *